US007909785B2

(12) United States Patent
Podrazhansky et al.

(10) Patent No.: US 7,909,785 B2
(45) Date of Patent: Mar. 22, 2011

(54) METHOD AND APPARATUS FOR IMPROVING LOCAL BLOOD AND LYMPH CIRCULATION USING LOW AND HIGH FREQUENCY VIBRATION SWEEPS

(76) Inventors: Yury M. Podrazhansky, Alpharetta, GA (US); Mikhail N. Lyubich, Duluth, GA (US)

( * ) Notice: Subject to any disclaimer, the term of this patent is extended or adjusted under 35 U.S.C. 154(b) by 632 days.

(21) Appl. No.: 11/464,328

(22) Filed: Aug. 14, 2006

(65) Prior Publication Data

US 2007/0167756 A1 Jul. 19, 2007

Related U.S. Application Data

(63) Continuation of application No. 10/761,726, filed on Jan. 21, 2004, now abandoned.

(60) Provisional application No. 60/449,149, filed on Feb. 24, 2003.

(51) Int. Cl.
*A61H 23/02* (2006.01)

(52) U.S. Cl. ..... 601/46; 601/47; 601/48

(58) Field of Classification Search ..... 601/46, 601/47, 48, 70–74, 79, 80, DIG. 12
See application file for complete search history.

(56) References Cited

U.S. PATENT DOCUMENTS 4,370,602 A * 1/1983 Jones et al. ..... 318/114
4,834,701 A 5/1989 Masaki
5,076,260 A * 12/1991 Komatsu ..... 601/59
5,097,821 A * 3/1992 Eakin ..... 601/47
5,113,852 A 5/1992 Murtonen
5,291,894 A * 3/1994 Nagy ..... 600/483
5,611,771 A 3/1997 Taylor
6,027,444 A * 2/2000 Franck ..... 600/38
6,027,463 A * 2/2000 Moriyasu ..... 601/46
6,036,662 A 3/2000 Van Brunt et al.
6,190,337 B1 2/2001 Nedwell
6,193,677 B1 2/2001 Cady
6,461,316 B1 10/2002 Lee et al.
7,402,144 B2 * 7/2008 McLeod ..... 601/27
7,442,174 B2 * 10/2008 Butler ..... 601/47
2004/0097842 A1 5/2004 Van Brunt et al.
2004/0167446 A1 8/2004 Podrazhansky et al.
2006/0173234 A1 * 8/2006 Nashwan ..... 600/2

OTHER PUBLICATIONS

Vitafon; The Purpose and Operative Physiological Mechanism of the Vibroacoustic Effect; downloaded Feb. 9, 2004, from http://www.vitafon.net/tech/vozd/vozd.html.

* cited by examiner

*Primary Examiner* — Danton DeMille
(74) *Attorney, Agent, or Firm* — Mehrman Law Office P.C.; Michael J. Mehrman

(57) ABSTRACT

A processor (10) controls the operation of the device and preferably provides for a plurality of operational algorithms or modes. A program switch (18) allows the user to select which algorithm will be used. The processor drives an inverter (12), which drives a power amplifier or bridge (13). The output of the bridge 13 is connected to one or more transducers 16. When the user presses the switch (19A), the processor begins the algorithm. One or more of the transducers are placed on the patient's body in the area to be treated. The algorithms provide for lower-frequency and higher-frequency sweeps, which the transducers convert to microvibrations which, in turn, massage not only the muscles and the larger blood vessels, but also the smaller blood vessels and capillaries, and provide for improved blood circulation in the affected area, thereby relieving pain and enhancing recovery.

36 Claims, 3 Drawing Sheets

METHOD AND APPARATUS FOR IMPROVING LOCAL BLOOD AND LYMPH CIRCULATION USING LOW AND HIGH FREQUENCY VIBRATION SWEEPS

CROSS-REFERENCE TO RELATED APPLICATION

This application is a continuation of U.S. patent application Ser. No. 10/761,726, filed Jan. 21, 2004 now abandoned, which claims the priority of U.S. Provisional Patent Application Ser. No. 60/449,149, filed on Feb. 24, 2003. The entirety of each of the above is hereby incorporated herein by reference.

TECHNICAL FIELD

This invention generally relates to increasing the circulation of bodily fluids and more particularly, to vibrational and sonic devices for locally increasing blood and lymph circulation.

BACKGROUND

Effective treatment of most injuries and diseases requires, at a minimum, an adequate quantity of blood, a good quality of blood, and good delivery of blood to the injured or diseased area. In many cases, the presence of these three items will provide for satisfactory healing or recovery. However, an insufficiency in one or more of these items can cause healing or recovery to be significantly prolonged or even impossible. For example, even where the patient has an adequate supply of blood of acceptable quality, the delivery of the blood to the desired area may be hampered or even severely restricted by a present or past injury or injuries, and/or present or past disease or diseases. In such a case, the blood delivered will not be of sufficient quantity to allow the body to mount a vigorous attack on the injury or healing and so healing or recovery will be delayed or prevented. Also, poor blood circulation can, in and of itself, be the cause of reduced organ and muscle efficiency and capability and, in more severe cases, cause damage to organs, muscles, and other bodily parts.

One known method of increasing circulation is exercise, such as walking, running, cycling, etc. Unfortunately, many people do not have the time for exercise, do not want to exercise, or cannot exercise, such as many of the aged and infirm.

Another known method of increasing circulation is a massaging vibrator, also referred to as a massager, which vibrates the flesh against which it is positioned. A number of massagers exists today on the market place, all of which use vibrations having a high amplitude and a low frequency. These existing massagers only affect large diameter blood vessels, not small blood vessels and capillaries, so, although there was some benefit, the benefit was generally less than desired and/or is inadequate to achieve the desired result.

It has been discovered that, in addition to the pumping action of the heart, there are at least two other mechanisms which move blood through the circulatory system. One of these mechanisms is the "tremble" of blood vessels, and another of these mechanisms is a hydrodynamic pump effect when high frequency, low amplitude vibrations ("microvibrations") are applied to the blood vessel.

With respect to the first mechanism, it has been discovered that, when a person is engaged in exercise, the active muscles "tremble" in a certain range of frequencies, which causes the blood vessels to tremble, thereby moving blood through veins and capillaries. The effect of the "tremble" of blood vessels was discovered by Russian professor Dr. A. I. Arinchin and is described in his book. The book is in the Russian language, is titled *Fazy i periody serdechnogo ëTisikla*("*Internal And Peripheral Muscles And The Heart*"), and was published in 1974 by Minsk publishing company, Russia. The authors are listed as N. I. Arinchin and G. N. Nedvedskiya. Dr. Arinchin, when studying the mechanisms of peripheral blood circulation, found that muscular fibers vibrate. This vibration compresses and releases the blood vessels and, because veins have one-way valves in them, the blood is pushed along through the veins and the capillaries.

With respect to the second mechanism, externally-induced microvibrations also compress and release the blood vessels and, again, because veins have one-way valves in them, the blood is pushed along through the veins and the capillaries. Thus, these two mechanisms act as a hydrodynamic pump. Also, it is believed by the inventor that higher frequency microvibrations improve blood circulation by reducing the resistance of the blood to movement through the veins and capillaries.

In the Russian Federation inventor V. Fedorov invented an apparatus he called a "Vitafon" (Vita—from the Greek for "life" and "fone" from the Greek for "sound"). His goal was to design a universal apparatus which could cure a number of diseases. This apparatus rapidly swept through a range of audio frequencies, from very low frequencies to very high frequencies, applying a particular frequency in a particular band of frequencies for only a limited number of cycles, such as twelve short pulses, during a two minute cycle. This apparatus, as it repeatedly went through its range of frequencies, did induce some limited microvibrations but, because of the very limited number of pulses at any frequency, the apparatus took a long period of time to have any desired effect; even curing simple disorders took several months, and the effect was only temporary. Because of the limited number of pulses, blood circulation was only increased momentarily and minimally. "Momentarily" because the effect vanished when the external stimulation was removed. "Minimally" because blood particles sometimes stick together, or there are fat deposits in the vessels, so the valves are not able to open and close quickly, efficiently or thoroughly enough. Further, because of the brief application of the microvibrations in any frequency band, the blood vessels did not become conditioned to pump the blood once the external stimulus was removed.

In Germany, a similar device called the Novafon (Nostrafon) also swept through a range of frequencies in a rapid manner, with the similar result that an improvement was obtained only after several days, and was minimal. Further, the penetration provided by Nostrafon did not provide for deep penetration, and the penetration that was available was only for a small area, thus further severely limiting its effectiveness.

The beneficial effects of trembling and microvibrations have not been previously recognized or appreciated so only low frequency vibrations have been used, or high frequencies were included only as part of a band when sweeping from low frequencies to high frequencies, with the result that the prior art massagers did not induce, or did not adequately induce, trembling or microvibrations, only affected large vessels, not the small veins and capillaries, only affected limited areas, and/or did not provide for deep penetration, and, therefore, often did not give the desired improvement, especially in the problem areas.

A number of persons in the past have also attempted to improve blood circulation and/or kill disease by use of generators which applied electric impulses directly to the body. For example, Mr. Fisher (1880s) and Mr. Rife (in the early 1930s) designed audio frequency generators to cure sickness in human body. Also, Tesla, Lakhovsky, Voll, and Nagier created different frequency generators and some of them even specified what frequency to use. Their devices typically applied electrical pulses with amplitude up to 20 volts to the human body. The current was not directly controlled and was dependent on the impedance of the body at the application point. Dry skin has a higher impedance and results in reduced current, whereas moist skin has a lower impedance and results in increased current. Therefore, a danger existed that the use of the wrong voltage for a skin type could result in no effect or result in some cells and nerve ends being destroyed. In the latter case, pain will reduced, leading the person to believe that there is healing, but, in reality, there is no healing effect, just temporary pain reduction, and there may be damage.

SUMMARY

One feature provided by the present invention is a device to benefit a living body. The device has a processor to provide an output signal, a driver responsive to the output signal to provide an amplified output signal, and a transducer responsive to the amplified output signal to provide a vibrational output. The output signal has a lower-frequency sweep and a higher-frequency sweep, and the transducer is placed in proximity to a desired location on the body so that the vibrational output will affect the desired location.

Another feature provided by the present invention is a method or process which benefits a living body. The method includes providing an output signal, amplifying the output signal to provide an amplified output signal, and converting the amplified output signal into a vibrational output in proximity to a desired location on the body. The output signal has a lower-frequency sweep and a higher-frequency sweep, and the transducer is placed in proximity to a desired location on the body so that the vibrational output will affect the desired location.

DETAILED DESCRIPTION

Figure 1:
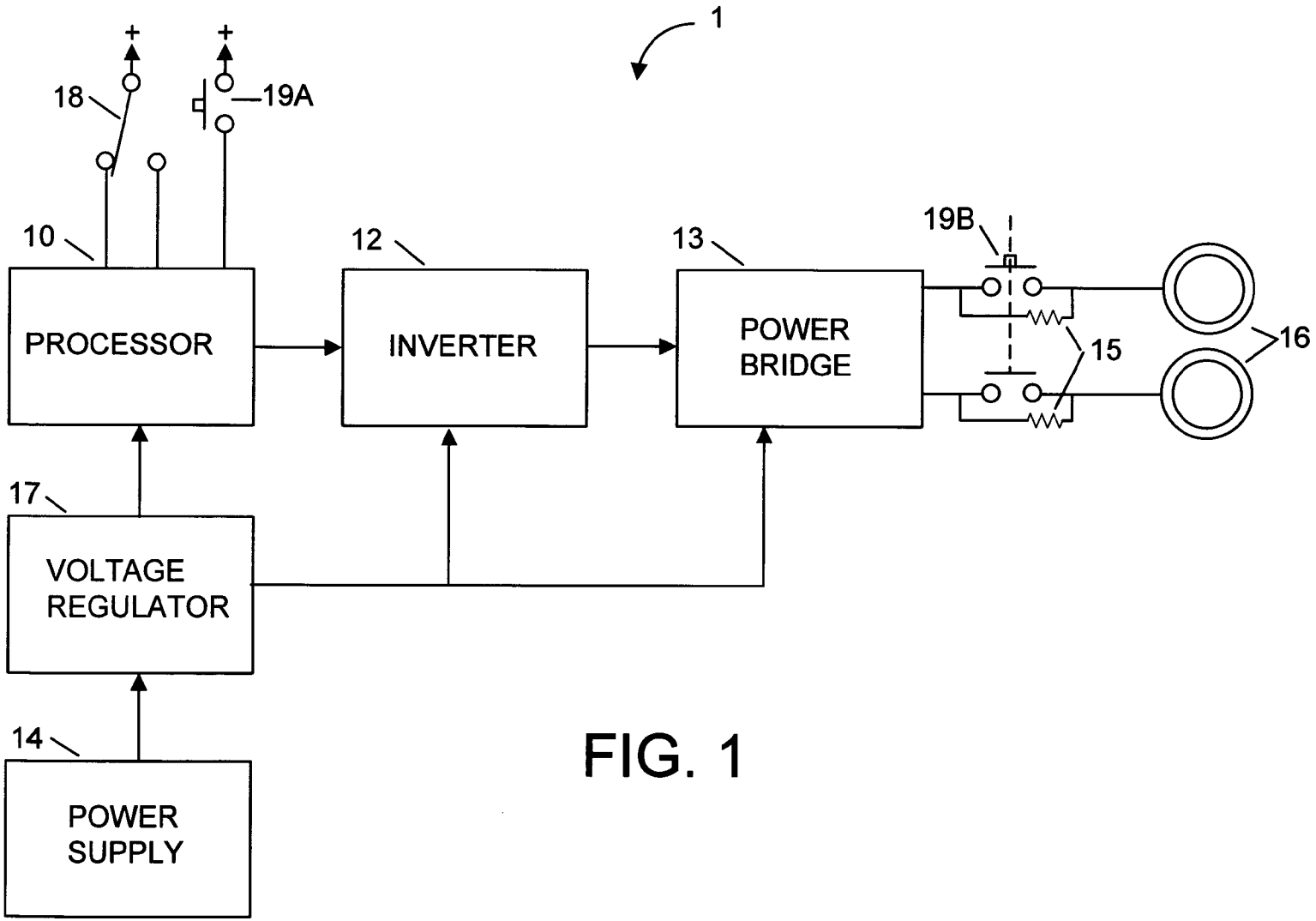
FIG. 1 is a block diagram of a preferred embodiment of the present invention.

FIG. 1 is a block diagram of a preferred embodiment of the present invention. In the operation of the preferred embodiment 1 of the present invention, microvibrations having a desired amplitude and frequency are applied to the injured body part for a desired time. The microvibrations preferably have an amplitude in the range of 5 to 500 microns, a frequency in the range of 5 Hz to 22 kiloHz, and are preferably applied for a time in the range of 12 to 36 minutes. However, values outside these ranges may be used and may result in the same or different results, depending upon the particular injury or disease and the particular physiology of the person being treated. Therefore, it should be understood that these values are not critical, but simply are preferred.

The preferred embodiment 1 comprises a processor 10, such as a microprocessor or microcontroller, which controls the operation of the device. The processor 10 drives an inverter 12, which drives a power amplifier or bridge 13. The inverter 12 serves to prevent the power bridge 13 from being damaged in the event that the processor 10 fails to operate properly, such as the outputs of processor 10 being unchanging, for example, being stuck at a logical 1 state or a logical 0 state. However, if desired, this safety feature can be eliminated and the processor 10 can directly drive the bridge 13. The inverter 12 and the bridge 13 may be collectively viewed as a power amplifier which amplifies the signal from the processor 10 to drive the transducers 16.

A power supply 14 provides operating power for the various components in the preferred embodiment 1. A voltage regulator 17 provides a regulated output voltage to those components requiring same which, in the preferred embodiment, are the processor 10, inverter 12, and bridge 13. If desired, inverter 12 and/or bridge 13 may be provided with unregulated power from the power supply 14. However, if unregulated power is used, the output power applied to the patient either must be monitored and regulated by another device, or the output power will fluctuate depending upon the output voltage of the power supply 14, which will generally fluctuate depending upon the input voltage to the power supply 14. In the case of a line-powered device, the input voltage will fluctuate depending upon the stiffness of the line voltage. In the case of a battery-powered device, the voltage provided by the power supply 14 may decrease as the battery voltage falls.

A program switch 18 allows the user to select which algorithm will be used by the processor 10. A two-position switch 18 is shown for convenience of illustration. However, the present invention is not limited to two algorithms but may provide for a plurality of algorithms. Therefore, switch 18 may be replaced by a multiple-position switch, a touchpad, a touch-sensitive screen, a connection to a computer, such as a personal computer, etc.

The output of the bridge 13 is connected to one or more transducers 16. In the preferred embodiment, a switch 19 is connected between the bridge 13 and the transducer 16, and a resistor 15 is placed in parallel with the switch 19. In this embodiment, the processor 10 monitors the power output by the power bridge 13. This may be done even when the device is in the "off" state by the processor 10 causing the power bridge 13 to operate at a very low level, or only intermittently, and by the processor 10 monitoring the power provided by the bridge 13. When the user presses the switch 19B, the resistor 15 will be bypassed, thus allowing the transducer 16 to draw more power from the bridge 13, and the processor 10 will interpret this as a user instruction to start the process. In another embodiment, the power bridge does not have to provide any power when the device is in the "off" state and, when the user presses the switch 19A, the processor 10 begins the process. These methods of starting the process are not mutually exclusive, so may be used together, or another desired means of starting the process may be used.

In operation, the user, or a doctor, or nurse, or some other person, places one or more of the transducers on the patient's body over, or near, or surrounding, the area to be treated. The transducers may be held in place by any desired means, including having the patient lie on them, straps or belts, suitable adhesives or adhesive devices, such as are commonly used for ECG tests, etc. Once the transducers are in position, a switch 19 is pressed, thereby starting the process. The processor 10 then implements the algorithm selected by switch 18, and performs the process for the desired time. The desired time for a process may be preprogrammed into the processor 10, may be user-selectable by means of another switch (not shown) or a connection or port (not shown) for connection to an external device, such as a personal computer, or may run continuously, preferably but not necessarily with a maximum time limit for safety, until the user presses a switch 19 again.

Figure 2:
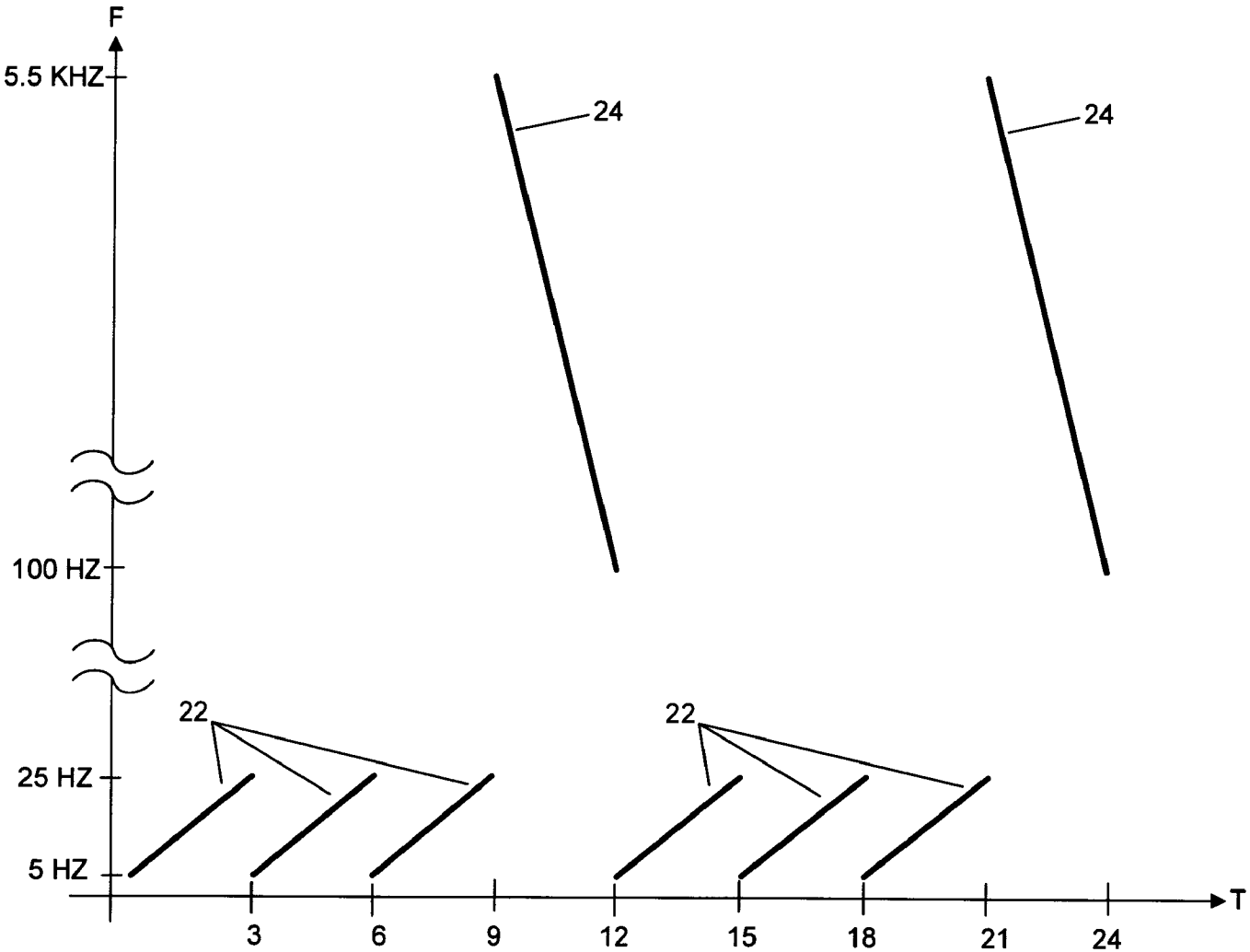
FIG. 2 illustrates an exemplary algorithm performed by the preferred embodiment of the present invention.

Turn now to FIG. 2, which illustrates one exemplary algorithm performed by the preferred embodiment of the present invention. Upon starting, a series of three upward lower-frequency sweeps 22 is made, from around 5 Hz to 25 Hz, with each sweep lasting approximately 3 minutes. Then, a downward higher-frequency sweep 24 is made, from around 5.5 kHz to 100 Hz, with this sweep lasting approximately 3 minutes. The sweeps are then repeated until the specified algorithm time has elapsed or the user instructs the processor to stop the process. The frequency and time values mentioned herein are preferred, but are not critical.

Figure 3:
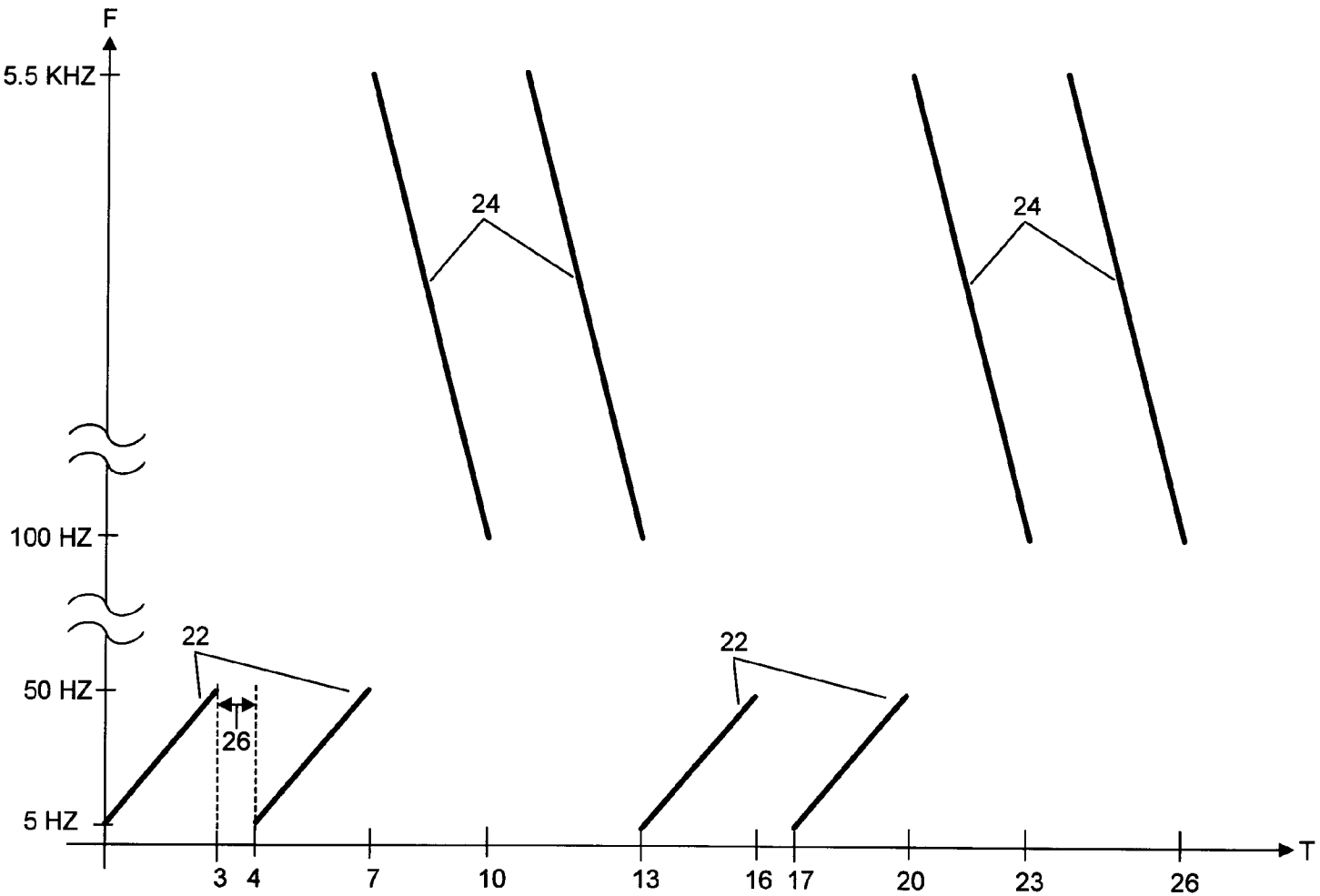
FIG. 3 illustrates another exemplary algorithm performed by the preferred embodiment of the present invention.

Turn now to FIG. 3, which illustrates another exemplary algorithm performed by the preferred embodiment of the present invention. Upon starting, a series of two upward lower-frequency sweeps 22 is made, from around 5 Hz to 50 Hz, with each sweep lasting approximately 2 to 4 minutes. Then, a series of two downward higher-frequency sweeps 24 is made, from around 5.5 kHz to 100 Hz, with this sweep lasting approximately 3 minutes. The sweeps are then repeated until the specified algorithm time has elapsed or the user instructs the processor to stop the process. The frequency and time values mentioned herein are preferred, but are not critical.

Also, FIG. 3 illustrates that an optional pause 26 may be made between sweeps. Although only one pause 26 is shown for convenience of illustration, a pause 26 may be inserted between similar sweeps, that is, between sweeps 22 and/or between sweeps 24, or between different sweeps, that is, between a sweep 22 and a sweep 24, or vice versa.

Further, although the figures show the lower-frequency sweeps 22 as being upward sweeps, this is only a preference, and not a requirement, and a lower-frequency sweep 22 could be a downward sweep. Further, if desired, different sweeps 22 may be different, that is, one sweep 22 may be an upward sweep while another sweep 22 is a downward sweep. Likewise, although the figures show the higher-frequency sweeps 24 as being downward sweeps, this is only a preference, and not a requirement, and a higher-frequency sweep 24 could be an upward sweep. Further, if desired, different sweeps 24 may be different, that is, one sweep 24 may be an upward sweep while another sweep 24 is a downward sweep. Also, either a lower-frequency sweep or a higher-frequency sweep, and either upward or downward, can be used as the first sweep, and/or the last sweep, as desired. Also, the sweep can be continuous or stepped, and the number of steps can be fixed, can depend upon the mode selected, or can be user-controlled, and can be any desired number of steps, primarily limited by cost, time and/or processing considerations. Further, the total duration of a sweep, the number of repetitions, and/or the total duration of the process can be as desired, and can be fixed, can depend upon the mode selected, or can be user-controlled, primarily limited by cost, time and/or processing considerations. In addition, the sweep waveform may be chopped, with a chop frequency as desired, and with a duty cycle as desired, and can be fixed, can depend upon the mode selected, or can be user-controlled, primarily limited by cost, time and/or processing considerations. Although it is preferable that the user select a mode and complete the process for that mode, it is allowable for the user to start or stop the process at any point, to switch modes or power levels at any point, or even to pause and then restart a process at any point, the limiting factors primarily being ease of use (not having too many switches or options, which can be confusing to some people), cost, and size.

In one embodiment, for reasons of economy of cost and simplicity of programming, the clock of the processor 10 is not tightly controlled, and uses a resistor-capacitor combination to set the clock frequency, rather than using a crystal-controlled oscillator. Also, in one embodiment, for reasons of economy of cost and simplicity of programming, the sweeps are not linear, but are stepped. Also, in one embodiment, the sweep waveform is not continuous but is a chopped sweep. For example, in one embodiment, the process is as follows: (a) a series of lower-frequency pulse sets, the series lasting approximately 2½ minutes, having a frequency of around 5 Hz, which frequency cannot be directly heard because of the low frequency, but which sounds as a series of "pops" as each set starts and stops, and with the pulse set repetition rate (the chopping frequency) increasing within a series; (b) one repetition of (a) above; (c) a series of downward higher-frequency chopped, stepped sweeps, having an approximate chop period of 1 second at a 50% duty cycle, followed immediately and continuing into a series of downward lower-frequency chopped, stepped sweeps, the combination of the higher-frequency series and the lower-frequency series lasting for approximately 3 minutes; (d) three repetitions of (c) above; and (e) one repetition of (a) above.

The present invention therefore provides a method and apparatus for locally increasing blood circulation in the human body. Also, different algorithms, meaning different numbers and directions of sweeps, frequencies, and duration can be used for different circulatory problems, different persons, and different depths of penetration, being generally directed to the purpose of increasing local blood circulation in, around, or near an affected area.

In an alternative embodiment of the present invention, the user can control the power level being applied, either by selecting a value for the resistor 15, using a switch to instruct the processor 10 of the desired power level, or any other desired and convenient means. In another alternative embodiment of the present invention, light emitting diodes or other indicators may be used to shown the user that the device is operating. In another alternative embodiment of the present invention, a sensor or other device is used to provide information regarding the heart rate, or to allow the processor 10 to measure the heart rate, so as to provide information to the processor 10 for adjusting the various frequencies, durations, sweep directions, pauses, etc., of an algorithm. For example, if the heart rate becomes too high, the power level may be reduced, pauses may be inserted or lengthened, the duration of the treatment may be shortened or terminated, etc.

Both the lower-frequency components and the higher-frequency components serve, to at least some degree, the purpose of increasing the circulation. In particular, the lower frequency components primarily affect the larger vessels, and can provide for deeper penetration at lower power levels, and the higher frequency components primarily affect the smaller vessels and capillaries, and can provide for more effective localized heating. It would seem that simply providing frequencies at all ranges at the same time (such as by using multiple transducers) would be beneficial. However, this would be costly, because of the duplication of the various components. Further, providing frequencies at all ranges at the same time may cause problems, such as an excessive reduction blood pressure, irritation of the underlying flesh, excessive heating of the underlying flesh, etc. Therefore, although providing frequencies at all ranges at the same time is contemplated by the present invention, it is not a preferred embodiment of the present invention.

However, it is contemplated by the present invention to provide more than one frequency at a time. For example, two frequencies may be simultaneously provided by performing the lower-frequency sweep at the same time as the higher-frequency sweep. Generally, the lower-frequency sweep is of a shorter duration than the higher-frequency sweep, so the lower-frequency sweep could be provided at the beginning of the higher-frequency sweep, at the end of the higher-frequency sweep, somewhere between the beginning and the end of the higher-frequency sweep, or even partially overlapping the beginning and/or the end of the higher-frequency sweep.

Consider now some practical applications of the present invention, which acts to increase and/or improve blood and/or lymph circulation.

The living body has large veins, small veins, and capillaries, and larger and small lymphatic vessels. All parts of the body depend upon an adequate supply of food, water, oxygen, lubrication, and protection, which are provided via the circulatory and lymphatic systems. Even the nerve cells in the nervous system need to be nourished. If poor blood circulation reduces delivery of nutrients to the nerve cells then the communication between the brain and the associated parts of the body is impeded and/or "noise" is introduced into the communications. If the information provided by the nerve cells is very slow and/or very small, but distorted or noisy due to reduced performance of the nerve cells, then the brain may be overwhelmed by the distortion or noise and cannot properly interpret those small and/or slow signals. Thus, as a result of the reduced circulation, tingling, numbness, paralysis, lack of sensitivity, spasms, and/or lack of fine or even gross motor control functions, etc., can be the result. If the brain cannot communicate with the nerve cells in a part of the body, the brain loses control over that part of the body. As a result of the improved circulation, the nerve cells can operate and communicate with the brain more effectively, so that the brain may regain at least some control over the affected part of the body. Thus, one benefit of applying the microvibrations is improved performance and conductivity of the nerve fibers.

Another practical application of the present invention is to reduce the blood pressure. Each blood vessel, because of its length, width, and location within or exterior to muscles and organs, has an optimal frequency of stimulation. The present invention, by sweeping the frequencies, provides each vessel with its preferred frequency of microvibration. This reduces the vascular resistance to movement of the blood through the vessel. Veins, as mentioned herein, have valves, which under the microvibration effect, provide a strictly ordered pumping movement of the blood, instead of chaotic movement with little or no pumping action.

Further, the present invention is not limited to the application of sinusoidal waves. The present invention contemplates and includes the use of pulses and/or square or other non-linear waveforms, which have harmonics, and different harmonics will apply to different sizes of veins and capillaries.

Another practical application of the present invention is to improve kidney performance. If blood flow to the kidney is restricted, the kidney cannot properly do its job of cleansing the blood. As a result, salts can build up and blood pressure can increase, even to dangerous levels. The present invention improves the blood delivery to the kidneys, thus allowing them to more efficiently perform their blood-cleansing duties, and thereby reducing the blood pressure.

Another practical application of the present invention is to remove or reduce hematomas. A hematoma can result from surgery, injury, or other trauma, and can persist for a long time if circulation is impeded. The present invention helps to remove hematomas by increasing the blood circulation, thus allowing the hematoma to be absorbed more quickly.

Another practical application of the present invention is to relieve the pain and disability of arthritis. Arthritis is an inflammation of the joint and can be mild, severe, or even totally disabling. There are both known and unknown causes for arthritis. For example, one form of arthritis is commonly known as gout, and may be caused by excessive consumption of protein-rich food, or by the inability of the kidneys to properly handle even normal amounts of protein in food. Arthritis is commonly treated by use of anti-inflammatories, but some of these have an adverse side effect on the kidneys and so cannot be tolerated by all persons. The present invention provides for increasing the blood circulation to the affected area, thereby allowing for the removal of gout-causing deposits and, with the proper power level, provides for controlled, localized heating of the affected area, thereby also increasing the blood circulation and, further, providing a soothing, pleasant feeling. Thus, the prevent invention reverses the inflammatory process without medication.

Another practical application of the present invention is to decrease back pain and improve mobility. The weak muscles in the back and their limited responses are often the cause of disorders occurring in the spine. In many cases, the muscles are tight and exercise must be started very slowly, so as to loosen up the muscles, in order to prevent further injury. Further, in many cases, the back pain, in and of itself, causes the body to contort in a way which only aggravates the injury and the pain. This cycle is best broken by reducing or eliminating the pain, which allows the body to assume normal posture, which further reduces the stress and pain, and so on. Therefore, prior to, and after, exercise, sport, or work which involves the back, the therapy procedure provided by the present invention should be used. For example, if stress is the cause of the pain in the back, but no other disorders are present, or were previously present, then the use of the present invention may cause the muscle pain to be reduced or even disappear after as few as one or two procedures. To make sure that the therapy is as beneficial as possible, and to avoid residual problems manifesting themselves shortly thereafter, it is preferable to have five or six procedures.

The recommended procedure is to apply the microvibrational therapy provided by the present invention up to 40 minutes before the training, and again within 1 to 4 hours thereafter. If the stressful event is to be exercise, it is preferable not to simultaneously train all the muscles, it is better to first perform the therapy on the larger or main muscles ones, to train those muscles, and then perform the therapy again on those muscles before moving on to perform the therapy upon, and train, smaller or lesser muscles.

The spine may also develop or cause systems of such pathological conditions as an intervertebral disc hernia, radiculitis, and edema. In many cases, it is not simple to determine an entire set or appropriate set of just physical exercises; a qualified physician and/or special devices may be needed. Also, it is particularly important to take into consideration the probability of an inflammatory process. If there is even the smallest probability of an inflammatory process then the therapy of the present invention should preferably be applied in combination with anti-inflammatory means. Iodine is a simple anti-inflammatory means so, before application of the therapy of the present invention, the painful area should be wiped with an iodine solution. However, one must not resort to strong anaesthetizing medicines without first consulting a doctor, because pain is an indicator of a disorder and ignoring the pain or reducing it without knowing the cause may create additional problems in future.

To restore blood supply in compressed neural fibers, for elimination of an edema, for resolving salts, and for enhancing the elasticity of intervertebral discs, the therapy of the present invention should be used. A treatment complex involves the use of the present invention on the respective portion of the spine, the renal area, and/or other organs, and, if necessary, the administration of an anti-inflammatory drug.

Enhancement of the blood supply to the intervertebral discs accelerates the restorative processes in them which, in turn, enhances their elasticity and enlarges the intervertebral orifices which, in turn, improves the functioning conditions of the neural fibers.

Part of the salt deposits, in the form of calcium compounds, will be resolved in osseous tissue, simultaneously enhancing the firmness of the tissue and smoothing the surface, thereby reducing irritation and inflammation. The calcium compounds may have been formed by excrescence simply because they had not been resolved by osseous tissue due to a poor blood supply. When salts are resolved, and tissue regeneration is increased, byproducts are created in the blood and should be removed, which increases the workload on the kidneys. Therefore, the treatment complex preferably includes renal therapy. If there are other inflammatory processes present, especially in the kidneys, for instance pyelonephritis, then it will be expedient to pay attention to a simultaneous medicinal treatment for the kidneys.

Salt resolving and restoration of elasticity to the intervertebral discs proceed slowly. To obtain a substantial improvement the procedures should be performed for a period of 2 or 3 months. With such proper treatment one can attain an enhancement of the intervertebral orifices and smoothing of its walls, which decreases the probability of wounding and compressing the neural fibers. If performed frequently and properly, as part of a prophylactic regime, the therapeutic effect of the present invention is cumulative, whereas simple application of pain-killing medication without the use of the present invention may result in further degradation.

Many patients who receive a treatment to reduce or eliminate pain simply stop taking the treatment for a variety of reasons: the absence of any noticeable result in the first stage; the pain is reduced so the patient thinks that there is no need for further therapy; or other health problems or issues may emerge. Unfortunately, if the patient prematurely stops the treatment, a rebound of the pain frequently occurs. It is not realistic to expect to cure every problem at once as the stress on the organism would likely be too great. Curing generally has to be done in stages, starting with the most serious conditions. People nowadays are always in a hurry and, having felt an improvement in one thing, rush to take the treatment for the next ailment. The spine, however, is worth special attention; when it becomes healthy a number of problems will disappear by themselves. The concept of resolving many physical problems by correcting the spine is well known in the field of chiropractic.

Sometimes, due to the degree of the trauma, or the duration of the trauma, the spine disorder may become irreversible, such as in the case of a sciatica. In such cases the damage to the neural fibers, such as from compression, may already be permanent. However, the present invention can be used to prevent further degradation by maintaining the blood circulation and/or somewhat improving the blood circulation to the injured area.

Prophylactic procedures for spine ailments should preferably be started when performing simple tasks and movements does not already cause spasms or acute pain. Preferably, the spine areas where injuries have occurred in the past should be treated first, and then the cervical area of the spine should be treated. It is then expedient to switch over to treatment of the lumbar portion of the spine and, only after that, to treatment of the thoracic portion of the spine. It is not advisable to treat several portions of the spine simultaneously.

The sum total of the time of action upon the spine preferably should not exceed 25 minutes and it should not be longer than the treatment time for the kidneys.

In the combined treatment of the joints and spine it is preferable that the sum total of the treatment time upon the spine and joints should not be longer than the treatment time on the kidneys within 24 hours. Further, it is preferable that the duration of a single procedure on the spine and joints should not be longer than 25 minutes.

In the course of treatment of the spine some pain may occur due to the fact that restoration of the blood supply and the conductivity of the nerve fiber enables the pain signals to reach the brain, whereas before they were partially or totally blocked.

It happens sometimes that a person bends forwards and then cannot straighten up because of severe pain or without help from someone else. In such cases the painful site should be wiped with iodine solution and then the muscles should be massaged with the microvibrational action of the present invention. The transducers should be affixed to the painful area and the therapy started at the lower frequencies. Then, without switching off the device of the present invention, the person should slowly try to straighten up. If the pain or difficulty persists, the device is switched off, the person waits for 5 minutes in a comfortable posture, and then the device is switched on again for 1 minute and, without switching the device off, the person should again try to straighten up. This procedure can be repeated several times until the person is able to straighten up or it is apparent that no further benefit is being obtained from the treatment. In that case, the device should be switched to provide both lower-frequency and higher-frequency sweeps, and the procedure repeated several more times.

From the above, it will be appreciated that the present invention provides an apparatus and a method for using vibrational therapy to reduce or eliminate a variety of ailments, aches, and pains. Further, although the present invention has been particularly described with respect to human persons, the present invention can also be used upon other living bodies, such as animals, including but not limited to household pets and farm animals. Other procedures for using the present invention will become apparent to those of skill in the art upon a reading of the detailed description above in conjunction with the drawing figures. Therefore, the scope of the present invention is to be limited only by the claims below.

We claim:

1. A method to enhance local circulation of at least one of blood or lymphatic fluid in a living body, comprising:

generating an audio signal;

providing the audio signal to a transducer that converts the audio signal to a mechanical vibrational output consisting essentially of a series of pulses with amplitudes in the range of 5 to 40 microns;

applying the vibrational output to a specific location on the body to enhance the circulation of at least one of blood or lymphatic fluid in a part of the body near that specific location; and wherein the pulses define lower-frequency sweeps and higher-frequency sweeps;

wherein each lower-frequency sweep consists essentially of frequencies below 1000 Hz for stimulating blood circulation in larger blood vessels; and wherein each higher-frequency sweep consists essentially frequencies above 1000 Hz for stimulating blood circulation in smaller blood vessels and capillaries.

2. The method of claim 1 wherein each lower-frequency sweep consists essentially of a series of pulses defining an increasing frequency versus time profile.

3. The method of claim 1 wherein each higher-frequency sweep consists essentially of a series of pulses defining a decreasing frequency versus time profile.

4. The method of claim 1 wherein each lower-frequency sweep defines a linearly increasing frequency versus time profile.

5. The method of claim 1 wherein each higher-frequency sweep defines a linearly decreasing frequency versus time profile.

6. The method of claim 1 wherein the mechanical vibrational output consists essentially of a series of the lower-frequency sweeps between each higher-frequency sweep.

7. The method of claim 1 wherein the mechanical vibrational output consists essentially of a series of lower-frequency sweeps alternating with a series of higher-frequency sweeps.

8. The method of claim 1 wherein the pulses have amplitudes between 5 microns and 30 microns.

9. The method of claim 1 wherein the pulses have amplitudes between 10 microns and 40 microns.

10. The method of claim 1 wherein each higher-frequency sweep consists essentially of frequencies below approximately 22 kHz.

11. The method of claim 1 wherein applying the vibrational output to a specific location on the body comprises deliberately applying the vibrational output to at least one of the muscles, the joints, the tendons, or the ligaments of that specific location on the body.

12. The method of claim 1 wherein the mechanical vibrational output consists essentially of a signal pattern from a selected one of a plurality of predetermined output signal patterns, each predetermined output signal pattern providing the output signal with at least one lower-frequency sweep and at least one higher-frequency sweep, the at least one lower-frequency sweep being an upward frequency sweep, and the at least one higher-frequency sweep being a downward frequency sweep.

13. A device to enhance local circulation of blood or lymphatic fluid in a living body, comprising:

a processor providing an audio signal;

a driver responsive to the audio signal amplifying the audio signal; and a transducer responsive to the amplified audio signal producing a mechanical vibrational output consisting essentially of a series of pulses with amplitudes in the range of 5 to 40 microns, the transducer being placed at a specific location on the body to enhance the circulation of at least one of blood or lymphatic fluid in a part of the body near that specific location;

wherein the pulses define lower-frequency sweeps and higher-frequency sweeps;

wherein each lower-frequency sweep consists essentially of frequencies below 1000 Hz for stimulating blood circulation in larger blood vessels; and wherein each higher-frequency sweep consists essentially frequencies above 1000 Hz for stimulating blood circulation in smaller blood vessels and capillaries.

14. The device of claim 13 wherein each lower-frequency sweep consists essentially of a series of pulses defining an increasing frequency versus time profile.

15. The device of claim 13 wherein each higher-frequency sweep consists essentially of a series of pulses defining a decreasing frequency versus time profile.

16. The device of claim 13 wherein each lower-frequency sweep defines a linearly increasing frequency versus time profile.

17. The device of claim 13 wherein each higher-frequency sweep defines a linearly decreasing frequency versus time profile.

18. The device of claim 13 wherein the mechanical vibrational output consists essentially of a series of the lower-frequency sweeps between each higher-frequency sweep.

19. The device of claim 13 wherein the mechanical vibrational output consists essentially of a series of lower-frequency sweeps alternating with a series of higher-frequency sweeps.

20. The device of claim 13 wherein the pulses have amplitudes between 5 microns and 30 microns.

21. The device of claim 13 wherein the pulses have amplitudes between 10 microns and 40 microns.

22. The device of claim 13 wherein each higher-frequency sweep consists essentially of frequencies below approximately 22 kHz.

23. The device of claim 13 wherein the transducer applies the vibrational output to at least one of the muscles, the joints, the tendons, or the ligaments of that specific location on the body.

24. The device of claim 13 wherein the mechanical vibrational output consist essentially of a signal pattern selected from a selected one of a plurality of predetermined output signal patterns, each predetermined output signal pattern providing the output signal with at least one lower-frequency sweep and at least one higher-frequency sweep, the at least one lower-frequency sweep being an upward frequency sweep, and the at least one higher-frequency sweep being a downward frequency sweep.

25. A device to enhance local circulation of blood or lymphatic fluid in a living body, comprising:

means for providing an audio;

means responsive to the audio signal to amplify the audio signal; and means responsive to the amplified audio signal to provide a mechanical vibrational output consisting essentially of a series of pulses with amplitudes in the range of 5 to 40 microns for application to a specific location on the body to enhance the circulation of at least one of blood or lymphatic fluid in a part of the body near that specific location; and wherein the pulses define lower-frequency sweeps and higher-frequency sweeps;

wherein each lower-frequency sweep consists essentially of frequencies below 1000 Hz for stimulating blood circulation in larger blood vessels; and wherein each higher-frequency sweep consists essentially frequencies above 1000 Hz for stimulating blood circulation in smaller blood vessels and capillaries.

26. The device of claim 25 wherein each lower-frequency sweep consists essentially of a series of pulses defining an increasing frequency versus time profile.

27. The device of claim 26 wherein each higher-frequency sweep consists essentially of a series of pulses defining a decreasing frequency versus time profile.

28. The device of claim 27 wherein each lower-frequency sweep defines a linearly increasing frequency versus time profile.

29. The device of claim 28 wherein each higher-frequency sweep defines a linearly decreasing frequency versus time profile.

30. The device of claim 25 wherein the mechanical vibrational output consists essentially of a series of the lower-frequency sweeps between each higher-frequency sweep.

31. The device of claim 25 wherein the mechanical vibrational output consists essentially of a series of lower-frequency sweeps alternating with a series of higher-frequency sweeps.

32. The device of claim 25 wherein the pulses have amplitudes between 5 microns and 30 microns.

33. The device of claim 25 wherein the pulses have amplitudes between 10 microns and 40 microns.

34. The device of claim 25 wherein each higher-frequency sweep consists essentially of frequencies below approximately 22 kHz.

35. The device of claim 25 wherein the vibrational output means applies the vibrational output to at least one of the muscles, the joints, the tendons, or the ligaments of that specific location on the body.

36. The device of claim 25 wherein the mechanical vibrational output consists essentially of an output signal pattern selected from a selected one of a plurality of predetermined output signal patterns, each predetermined output signal pattern providing the output signal with at least one lower-frequency sweep and at least one higher-frequency sweep, the at least one lower-frequency sweep being an upward frequency sweep, and the at least one higher-frequency sweep being a downward frequency sweep.

* * * * *